United States Patent [19]

Schilling

[11] Patent Number: 4,497,421

[45] Date of Patent: Feb. 5, 1985

[54] MECHANICAL POST MIX BEVERAGE DISPENSING SYSTEM

[75] Inventor: William Schilling, Farmington, Conn.

[73] Assignee: Alco Foodservice Equipment Company, Miami, Fla.

[21] Appl. No.: 389,692

[22] Filed: Jun. 18, 1982

[51] Int. Cl.[3] ..... B67D 5/60

[52] U.S. Cl. ..... 222/144.5; 222/484; 222/486; 137/607

[58] Field of Search ..... 222/129.1, 144.5, 145, 222/481, 484, 485, 486, 487, 129, 129.2, 135, 136, 478; 137/607

[56] References Cited

U.S. PATENT DOCUMENTS

| | | | |
|---|---|---|---|
| 2,692,616 | 10/1954 | Glassenhart | 137/607 |
| 2,937,792 | 5/1960 | Firstenberg | 222/485 |
| 3,144,967 | 8/1964 | McClain | 222/144.5 |
| 3,168,967 | 2/1965 | Giampa | 222/129.1 |
| 3,339,805 | 9/1967 | Wheeler | 222/145 |
| 4,162,028 | 7/1979 | Reichenberger | 222/144.5 |

*Primary Examiner*—Stanley H. Tollberg
*Assistant Examiner*—Michael S. Huppert
*Attorney, Agent, or Firm*—Fishman & Dionne

[57] ABSTRACT

A mechanical post mix beverage dispensing system is presented in which one soda and/or water valve is common to a plurality of syrup valves. The common soda and/or water valve is automatically actuated upon actuation of any of the syrup valves to provide a desired syrup-soda or water mixture. The soda and/or water valve may also be actuated independently of the syrup valves to dispense only soda or water.

8 Claims, 5 Drawing Figures

MECHANICAL POST MIX BEVERAGE DISPENSING SYSTEM

BACKGROUND OF THE INVENTION

This invention relates to the field of beverage dispensing systems. More particularly, this invention relates to the field of post mix beverage dispensing systems wherein a base fluid, such as carbonated water or plain water is to be mixed with different selected syrups to provide drinks of different flavors.

Post mix bar dispensing systems have been known in the art. These prior art systems include both electrically operated valve systems and mechanically operated valve systems. Both the electrical and mechanical systems of the prior art require separate soda valves for each syrup valve, so that the total number of valves in each system is two times the number of flavors that can be dispensed. This valving requirement of the prior art results in a larger or more bulky dispensing head, and it also increases the possibility of leakage problems.

The solenoid operated systems of the prior art are known to have both safety problems and mixing problems. The mixing problems result from the unequal opening response characteristics of the solenoid valves due to the higher viscosity of the fluid in the syrup valves. The end result of this problem is that the proper proportion of syrup and soda is not mixed, and the drink does not taste right. Prior art mechanically operated post mix dispensing systems have typically used either spool valve configurations or poppet valve configurations. Each of these valving arrangements has had a number of disadvantages or problems.

An example of a prior art spool valve system is shown in U.S. Pat. No. 3,863,810. Among the disadvantages of such spool valve systems are: they require large travel to fully open the valves; they require relatively large push forces to operate in order to overcome seal friction; they require heavy biased springs to guarantee proper return of the spool valve when the push button is released (because of friction seals); they require separate soda valves and separate in and out passages for soda for each syrup station; they require accurate machining for proper sealing; they require large residual forces to overcome the friction seal; they are difficult to machine because high accuracy is essential; and they are hard to maintain in proper operating condition. In prior art mechanical configurations using poppet valves, the arrangement has usually involved a pair of poppet valves at each syrup or flavor station (one poppet valve for syrup and one poppet valve for soda) with a bridging bar between the operating stem of the syrup valve and the operating stem of the soda valve so that soda and syrup are dispensed simultaneously. These prior art mechanical configurations have had the disadvantage that: they require two valves (one soda and one syrup) at each mixing station; they result in a bulky dispenser head because of the separate and duplicate soda valve requirements; they incorporate O-ring poppet seals which create sticking friction and require heavy return springs to guarantee proper shut-off.

SUMMARY OF THE INVENTION

The present invention relates to an all mechanical post mix dispensing unit of the manually operated type. In the present invention a single soda or water valve is associated with and serves a plurality of syrup valves. That is, a single soda or water valve delivers soda for mixture with the syrups from several different syrup valves. In accordance with the present invention, operation of any one of a group of syrup valves automatically operates the associated single soda or water valve to deliver the appropriate mixture of syrup and soda or water to the mixing head of the post mix dispensing unit. The several syrup valves are arranged in a satellite array about the single common soda or water valve, and a bridging mechanism extends from each of the syrup valves to the soda or water valve so that manual operation of the syrup valve automatically results in operation of the soda or water valve. In addition, the soda or water valve may be independently operated, i.e., operated separately from any of the syrup valves so that soda or water may be dispensed without syrup.

The present invention also incorporates a shear seal design having contoured seats and flat seals. This seal configuration results in a reduction of sticking friction and creates a snap-type opening effect which has good sealing characteristics and requires low spring forces to effect good sealing.

The structure of the present invention results in a compact, reliable and highly effective post mix dispensing unit which reduces or eliminates many of the problems of the prior art units of this type. In particular, since the present invention has only a single soda or water valve associated with a plurality of syrup valves, the unit of the present invention is much more compact than units of comparable mixing capacity (i.e., the number of syrups which can be dispensed (of the prior art). In addition, the sealing structure of the present invention significantly reduces the operating forces which are required to operate the unit, without impairing the seal capabilities of the unit.

As an important feature of the invention, the unit may have a soda and a water valve (or more than one of each) with a satellite array of syrup valves associated with each. Furthermore, syrup valves from one satellite array may be easily switched to the satellite array of another soda or water valve to change the combinations of syrup/soda or syrup/water dispensed by the unit.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
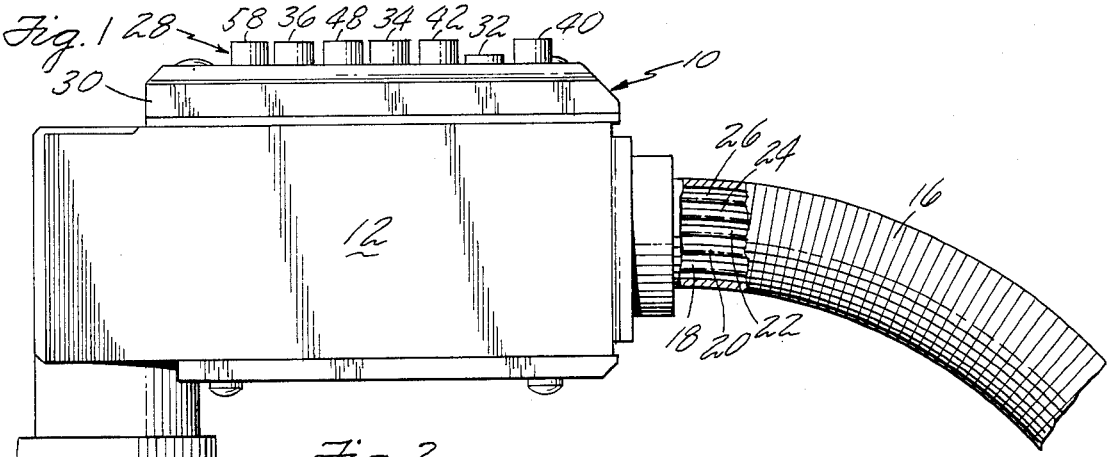
FIG. 1 is a side elevation view of the post mix bar dispensing unit of the present invention.
Figure 2:
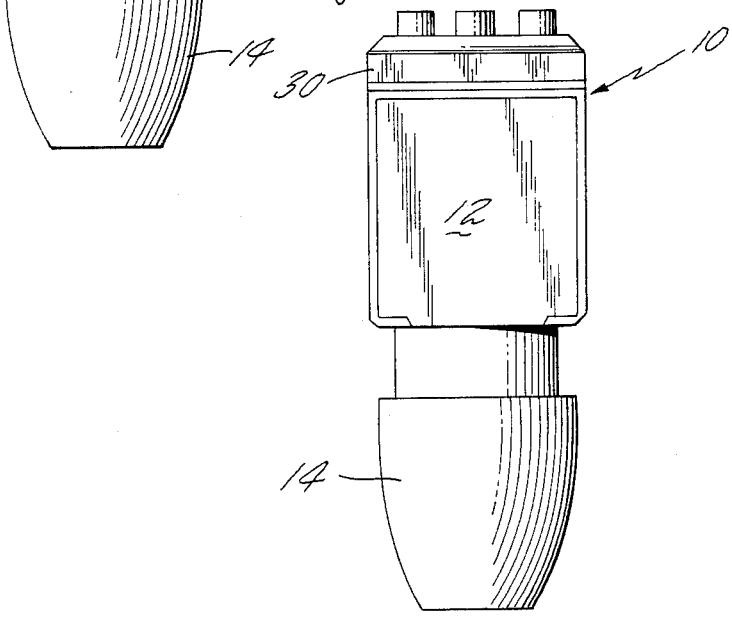
FIG. 2 is a front elevation view of the unit of FIG. 1.
Figure 3:
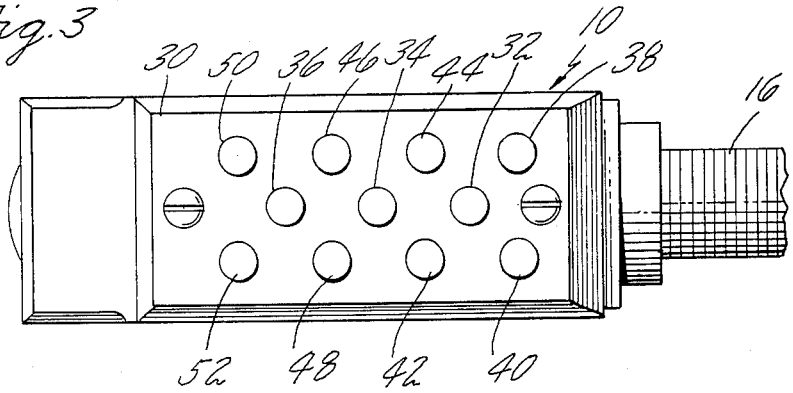
FIG. 3 is a top plan view of the post mix bar dispensing unit of the present invention.

Referring first to FIGS. 1, 2 and 3, the exterior features and appearance of the post mix bar dispensing unit 10 of the present invention are shown. While it will be understood that a unit made in accordance with the present invention need not be of exactly this size or shape, the showing in FIGS. 1, 2 and 3 (which is essentially full size) enables one to appreciate that the unit is very compact for its capacity and versatility.

The unit of the present invention has a housing or body 12, a mixing or dispensing head 14, a flexible hose 16, a plurality of flexible fluid conduits, such as 18 through 26, and a plurality of mechanical valve structures contained within housing 12, the operating buttons of which are indicated generally at 28. The operating buttons 28 protrude from a retainer plate 30 which can be removable for access to reset the buttons and valve structure. The individual conduits 18 through 26 are shown only for purposes of illustration. There will be an individual conduit for each syrup flavor, and the unit will also have a conduit for soda water and may also have a conduit for plain water. The conduits are all housed within hose 16, and the conduits are each connected to a remote source of syrup, soda or other fluid under pressure (not shown).

The selector buttons, which are indicated generally at 28, are each connected to an appropriate valve structure within housing 12. Referring to FIG. 3, where the selector button/valving array can best be seen, the unit has a first soda button 32, a second soda button 34, and a water button 36. These buttons 32, 34 and 36 are each associated, respectively, with individual valves in the body to dispense their associated fluids (sometimes being referred to as the base or mixing fluid). The two soda buttons are present only to increase the capacity of the unit; and the unit could, if desired, have only a single soda button. Similarly, water valve button 36 is included to increase the versatility of the unit. Soda valve button 32 has associated with it a first satellite group of syrup or flavor buttons 38, 40, 42 and 44; soda button 34 has associated with it a second group of satellite syrup or flavor buttons 46 and 48; and water button 36 has associated with it a third satellite group of syrup or flavor buttons 50 and 52. Each of the syrup or flavor buttons 38 through 52 is, of course, connected to an appropriate valve structure in housing 12 to control flow of its associated syrup or flavor.

Figure 5:
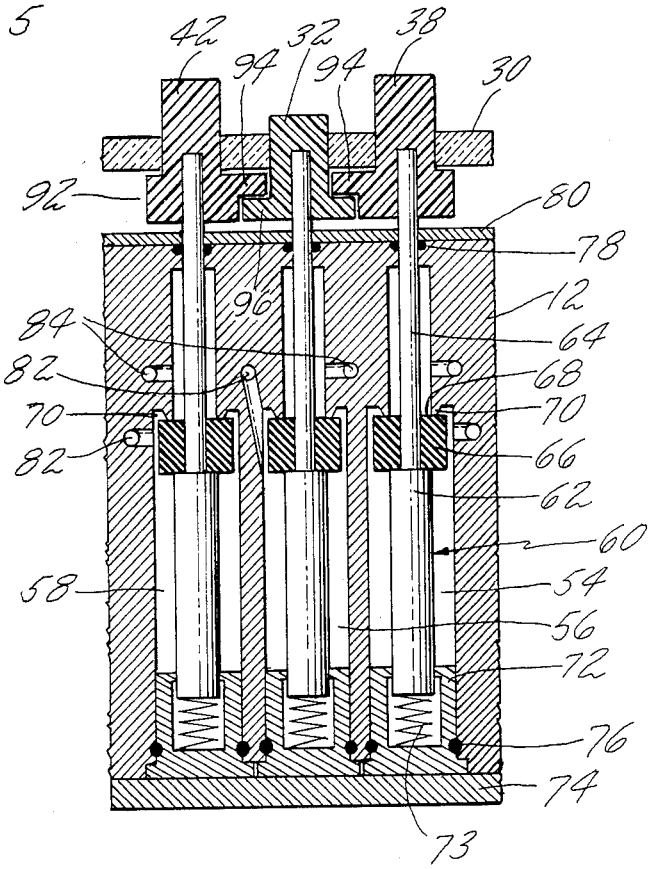
FIG. 5 is a sectional elevation view along line 5—5 of FIG. 4 showing several of the valve units.

Referring now to FIG. 5, housing 12 has a series of valve chambers formed therein for the valves associated with each valve button. In FIG. 5, three valve chambers, 54, 56 and 58 are seen. Valve chamber 56 is a valve chamber for soda, while valve chambers 54 and 58 are valve chambers for syrups. The valve structure in each valve chamber includes a valve stem 60 which has a large diameter lower portion 62 and a smaller diameter upper portion 64; and a valve plate or seal 66 which is of rubber or other elastomeric material with a flat upper sealing surface 68 is positioned at the shoulder between stem portions 62 and 64. This flat seal surface 68 seats against a contoured annular machined seal seat 70 to form an effective shear seal which will open with a snap action effect. The lower portion of valve stem 62 is held in a stem guide 72 which also houses a return spring 73 which urges the rubber seal 66 against the contoured seal seat 70 to provide an effective seal for the valve. The guide elements 72 are retained in housing 12 by a bottom retainer plate 74 which may be screw fastened to body 12, and O-ring seals 76 prevent leakage around each of the guide elements. Similarly, the reduced diameter portion 64 of each valve stem passes through the upper portion of housing 12 where it is sealed by O-ring seals 78 and also passes through retaining and guide plate 80 which may be a metal plate screw fastened to housing 12. Each valve chamber has associated with it an inlet passage 82 which delivers fluid to the valve area below the annular seal formed between valve seal element 66 and valve seat 70 and an outlet or discharge passage 84 above the valve location. The inlet passages 82 are connected individually to the conduits 18-26, and the discharge passages are connected to supply fluids to the interior of head 14.

The valve seal structure of the present invention is a shear seal having contoured seats and a flat seal element. This seal configuration results in a significant reduction of sticking friction and creates a snap type opening effect which has good sealing characteristics and requires low spring forces to effect good sealing. Thus, when an operating button is pushed to operate the valve, the valve operates easily and quickly, and the valve return springs 73 may be very light springs.

Still referring to the structure of FIG. 5, a portion of small diameter stem 64 projects above retainer plate 80, and the valve operating buttons are mounted on this portion of each stem with a mild friction fit. As seen in FIG. 5, soda button 32 is mounted on the stem of the center valve, and syrup buttons 38 and 42 are mounted on the valve stems on either side of the soda button 32. These operating buttons are retained in place by retainer 30 which defines a hollow interior operating space 92. An activating bridge 94 extends from each of the syrup buttons 38 and 42 below retainer plate 30, and each of these activating bridges overlaps an annular operating ring 96 on soda button 32. Thus, when operating force is applied to either syrup button 38 or syrup button 42 to move the button and valve downward to operate the syrup valve, activating bridge 94 engages operating ring 96 on soda button 32 to move soda button 32 and its associated valve structure downward to also open the soda valve. Thus, operation of either of the syrup buttons will automatically result in operation of the soda valve to supply both the desired syryp and soda to mixing and dispensing head 14.

Figure 4:
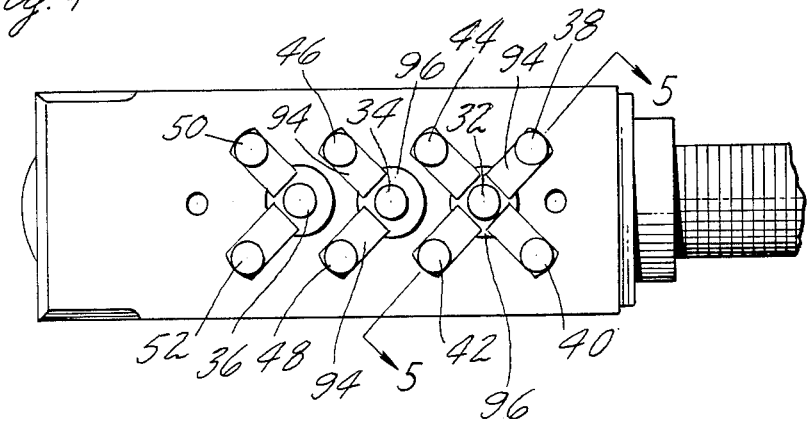
FIG. 4 is a view similar to FIG. 3, with the top cover plate removed.

The bridging feature between the syrup valves and the soda valve is an important feature of the present invention which contributes significantly to the compactness and other desirable features of the unit of the present invention. While valve bridging elements have been known in the past for post mix dispensing units, these prior art structures have still required an equal number of syrup and soda valves. By way of important contrast, a single soda valve of the present invention has a plurality of syrup valves in a satellite array about the soda valve. Thus, as best seen in FIG. 4, the soda valve associated with soda button 32 has around it a satellite array of four syrup buttons (38, 40, 42 and 44) and their associated syrup valves. A bridging element 94 extends from each of the syrup valves to overlap operating ring 96, so that the soda valve of button 86 will always be operated automatically regardless of which of the syrup buttons 38, 40, 42 or 44 is depressed. Of course, it will be understood that the satellite array of four syrup buttons and valve structures around the soda button and valve structure is shown only for purposes of illustration; and it will be apparent that a satellite array of a different number could be employed. Still referring to FIG. 4, a second soda button 34 and its associated valve structure have associated therewith a second satellite array of syrup buttons 46 and 48. As with the structure previously described, the syrup buttons 46 and 48 have activating bridges 94 which overlap operating ring 96 on soda button 34 to provide a second dispensing array in which a soda valve is automatically operated for soda dispensing whenever a syrup button is depressed for operation of its associated syrup valve. It will, of course, be understood that the presence of two soda valves is described herein merely to illustrate that the capacity of the system may be increased by the addition of a second optional soda valve.

Similarly, a third satellite array of syrup or flavor buttons 50 and 52 (and their associated valve structures) are associated with a third base or mixing fluid button 48 (and its associated valve structure). In this case, the button 48 and its associated valve structure dispense noncarbonated water, thus adding to the versatility of the unit.

As can be seen from a combined consideration of FIGS. 3, 4 and 5, the soda or water valves may be operated independently of the syrup valves to dispense unflavored soda or unflavored water. Thus, by depressing the soda button 34 or the water button 36 directly, the valve associated therewith will open to dispense only soda or water. This operation is possible because the operating ring 96 on each of these buttons is below the bridging structure 94 and thus can move downwardly and away from the bridging structure for independent operation of the soda or water valves. In the structure shown and described herein, since two valves are provided for supply of soda, it is not necessary that both soda valves be manually and independently operable to deliver unflavored soda. To that end, one of the soda valve buttons, in this case button 32, is formed with a short button top so that it is at or nearly level with the top of retainer 30 so as to be below the normal operating level of the buttons.

Referring again to FIGS. 4 and 5, an important feature of the present invention is illustrated in the interchangeability or switchability of various syrup and base or mixing fluid combinations. By simply unscrewing the screws which retain retainer plate 30 on housing 12, access can be had to the interior of the structure to change syrup and base fluid combinations. When retainer 30 is removed, a syrup button can be lifted off its stem and rotated 45° and then replaced on the stem to change its association from one base fluid valve to the adjoining base fluid valve. Thus, by way of example, syrup button 48 may be lifted off its stem, rotated 45° counterclockwise and replaced on its stem. This movement of button 48 will disassociate the valve of syrup button 48 from soda valve 34 and associate it with water valve 36. From then on, activation of syrup valve 48 will cause simultaneous action of water valve 36 and dispensing of flavored water rather than activating soda valve 34 and dispensing flavored soda as it would previously have done. Similarly, the association of button 46 and its valve may be changed from button 34 and its valve to button 36 and its valve; and, similarly, either or both of buttons 42 and 44 and their valves may be disassociated from soda button 32 and its valve and associated with soda button 34 and its valve. This interchangeability feature of the various syrup and base or mixing fluid combinations results in a much more flexible and versatile post mix bar dispensing unit than was heretofore possible. Rather than just using soda or water as the base or mixing fluids, three or more fluids can be used (depending on the number of base fluid valves) and various combinations of syrups can be arranged with these base or mixing fluid valves and easily changed depending on circumstances or desirability in the field. It is important to note that this changing of the valving arrangement can be easily accomplished by the user of the unit. All that needs to be done is to remove the retaining screws of retainer 30, remove the retainer, elevate, rotate and replace the syrup button on its stem, and replace the retainer plate 30. Thus, a highly versatile and desirable feature is incorporated in the unit of the present invention.

As will be apparent to those skilled in the art, the unit of the present invention is compact, versatile, and easy to operate. It overcomes a number of disadvantages of prior art post mix bar dispensing units and introduces various new features. It will also, of course, be understood that the unit may be used with various combinations of base or mixing fluids and various syrups, flavors or other fluids to be mixed with the base or mixing fluid.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A beverage dispensing unit comprising:

housing means for housing a plurality of valve elements, said housing means having a plurality of fluid inlets to receive a first fluid and a plurality of second fluids and a plurality of fluid outlets for delivery of fluids to a mixing head;

a first group of valve chambers in said housing means, a first of said first group of valve chambers being connected to receive a supply of a first fluid, and a plurality of second of said first group of valve chambers being arranged in an array with respect to said first valve chamber and being connected to receive supplies of second fluids;

first valve means in said first valve chamber of said first group;

second valve means in each of said second valve chambers of said first group;

first valve operating means associated with said first valve means of said first group to operate said first valve;

second valve operating means associated with each of said second valve means of said first group to operate each of said second valves;

bridging means from each of said second valve operating means of said first group to said first valve operating means of said first group to automatically operate said first valve means of said first group for delivery of said first fluid with a second fluid whenever a second valve operating means of said first group is operated for delivery of any selected second fluid;

a second group of valve chambers in said housing means, a first of said second group of valve chambers being connected to receive a supply of a first fluid, and a plurality of second of said second group of valve chambers being arranged in an array with respect to said first valve chamber and being connected to receive supplies of second fluids;

first valve means in said first valve chamber of said second group;

second valve means in each of said second valve chambers of said second group;

first valve operating means associated with said first valve means of said second group to operate said first valve;

second valve operating means associated with each of said second valve means of said second group to operate each of said second valves;

bridging means from each of said second valve operating means of said second group to said first valve operating means of said second group to automatically operate said first valve means of said second group for delivery of said first fluid with a second fluid whenever a second valve operating means of said second group is operated for delivery of any selected second fluid; and means for switching at least one of said second valve operating means and its bridging means of said first group to said second group for automatic operation of said first valve means of said second group whenever said one second valve operating means is thereafter operated.

2. A beverage dispensing unit as in claim 1 wherein:

said second valve chambers and the valves therein of said first group are arranged in a first satellite array about said first valve chamber of said first group and the valve therein; and said second valve chambers and the valves therein of said second group are arranged in a second satellite array about said first valve chamber of said second group and the valves therein.

3. A beverage dispensing unit as in claim 2 wherein:

said first valve operating means of said first group includes an operting element adopted to cooperate with said bridging means from each of said second valve operating means of said first group;

said bridging means comprises an extension from each of said second valve operating means of said first group overlapping said first valve means operating elements of said first group;

said first valve operating means of said second group includes an operating element adopted to cooperate with said bridging means from each of said second valve operating means of said second group; and said bridging means comprises an extension from each of said second valve operating means of said second group overlapping said first valve means operating elements of said second group.

4. A beverage dispensing unit as in claim 3 wherein:

said first valve operating means of each of said first and second groups are operable independently of any of said second valve operating means of the respective group.

5. A beverage dispensing unit as in claim 1 wherein:

each of said valve chambers of each of said first and second groups has a contoured seal seat; and each of said valve elements has an elastomeric seal with a flat sealing surface for sealing engagement with said contoured seat; and including spring means for normally urging each of said sealing surfaces against its respective contoured seat.

6. A beverage dispensing unit as in claim 5 wherein:

said second valve chambers and the valves therein of said first group are arranged in a first satellite array about said first valve chamber of said first group and the valve therein; and said second valve chambers and the valves therein of said second group are arranged in a second satellite array about said first valve chamber of said second group and the valves therein.

7. A beverage dispensing unit as in claim 6 wherein:

said first valve operating means of said first group includes an operating element adopted to cooperate with said bridging means from each of said second valve operating means of said first group;

said bridging means comprises an extension from each of said second valve operating means of said first group overlapping said first valve means operating elements of said first group;

said first valve operating means of said second group includes an operating element adopted to cooperate with said bridging means from each of said second valve operating means of said second group; and said bridging means comprises an extension from each of said second valve operating means of said second group overlapping said first valve means operating elements of said second group.

8. A beverage dispensing unit as in claim 7 wherein:

said first valve operating means of each of said first and second groups are operable independently of any of said second valve operating means of the respective group.

* * * * *